US006523372B1

(12) United States Patent
McDaid et al.

(10) Patent No.: US 6,523,372 B1
(45) Date of Patent: Feb. 25, 2003

(54) RETRACTABLE WIRE LOCK WITH SECURE RESET MECHANISM

(75) Inventors: Cornelius McDaid, Randolph, MA (US); Jason A. Morris, Malden, MA (US); Donald H. Warren, Natick, MA (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 10/096,677

(22) Filed: Mar. 13, 2002

Related U.S. Application Data

(60) Provisional application No. 60/275,739, filed on Mar. 14, 2001.

(51) Int. Cl.[7] ..... E05B 37/02

(52) U.S. Cl. ..... 70/18; 70/30; 70/233; 70/312

(58) Field of Search ..... 70/18, 30, 49, 70/233, 312, 315–317

(56) References Cited

U.S. PATENT DOCUMENTS

| | | | | | |
|---|---|---|---|---|---|
| 3,906,758 | A | * | 9/1975 | Hurwitt | 70/30 |
| 4,543,806 | A | * | 10/1985 | Papandrea et al. | 70/30 |
| 4,610,152 | A | * | 9/1986 | Duringer | 70/30 |
| 4,665,724 | A | * | 5/1987 | Sakai | 70/30 |
| 4,756,171 | A | * | 7/1988 | Homar | 70/18 |
| 4,896,517 | A | | 1/1990 | Ling | 70/18 |
| 5,156,028 | A | * | 10/1992 | Jiang | 70/30 |
| 5,560,232 | A | * | 10/1996 | Chen | 70/30 |
| 5,786,759 | A | * | 7/1998 | Ling | 70/30 X |
| 5,787,736 | A | * | 8/1998 | Ling | 70/26 |
| 5,832,752 | A | * | 11/1998 | Zeller | 70/30 |

FOREIGN PATENT DOCUMENTS

| | | | | |
|---|---|---|---|---|
| CH | 142959 | * | 1/1931 | 70/49 |
| DE | 3410047 | * | 10/1985 | 70/312 |

* cited by examiner

*Primary Examiner*—Lloyd A. Gall
(74) *Attorney, Agent, or Firm*—Michael Best & Friedrich LLP

(57) ABSTRACT

A new reset mechanism for an existing retractable wire lock. In one embodiment, the internal component for placing the prior art lock in reset mode by pushing the locking head into the lock casing is replaced by a component with a reset button. In a second embodiment, the internal component for placing the prior art lock in reset mode is replaced by a component with a reset button and that further includes a mechanism for using the locking head to retain the component in the reset position so that the button does not have to be continually pressed during the reset procedure.

8 Claims, 2 Drawing Sheets

RETRACTABLE WIRE LOCK WITH SECURE RESET MECHANISM

CROSS-REFERENCES TO RELATED APPLICATIONS

The applicant wishes to claim the benefit of U.S. Provisional Patent Application No. 60/275,739, dated Mar. 14, 2001 for RETRACTABLE CABLE LOCK WITH RESET MECHANISM in the names of Cornelius McDaid, Jason A. Morris, and Donald H. Warren.

STATEMENT REGARDING FEDERALLY SPONSORED RESEARCH OR DEVELOPMENT

Not Applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

1. Field of the Invention

The present invention relates to locks, more particularly, to a mechanism that prevents accidental resetting of the combination of a retractable wire lock.

2. Description of the Related Art

A popular wire lock on the market today is a portable model with a thin, retractable wire, as disclosed in U.S. Pat. No. 4,896,517, issued to Ling. The wire, with a locking head, extends from a wire hole on the top surface of the lock casing. At the opposite end of the top surface is a locking hole into which the locking head is inserted. Between the two holes is a set of coaxial combination dials. When the correct combination is set, the locking head can be snapped into the locking hole. If the combination is changed from the correct combination, the locking head is secured in the locking hole.

The lock is designed so that the user can reset the combination. The combination is reset by first setting the current correct combination, and then pushing the locking head down into the wire hole until it hits a stop. The user then sets the new combination and pulls the locking head from the wire hole. Now the new combination is locked in and must be used to operate the lock.

The problem with this mechanism that is addressed by the present invention is that it is relatively easy to change the combination without realizing it. The typical problem scenario is that the user finishes using the lock and leaves the dials set to the correct combination. Then the lock is dropped into a bag or other container. The lock is either dropped onto its top edge or another item is dropped on top of the lock, pushing the locking head into the wire hole. While rummaging around in the bag for the lock or some other item, one or more of the dials are inadvertently turned. The next time the lock is used, the user pulls the locking head from the wire hole, resetting to the new combination. Up to this point there would be no real problem, except that the user most likely is not going to look at the combination dials because she already "knows" what the combination is. So the user snaps the locking head into the locking hole and spins the dials off the correct combination without looking. Now, the combination has been set to something other than what the user thinks it is, but doesn't realize it until she later tries to open the lock. At this point, since the user does not know the current correct combination, the only way to release the device being secured is to cut the wire, thereby destroying the lock.

BRIEF SUMMARY OF THE INVENTION

An object of the present invention is to provide a retractable wire lock in which it is much more difficult than in similar locks of the prior art to inadvertently reset the combination.

The present invention is an improvement of an existing lock described in U.S. Pat. No. 4,896,517 (the '517 patent), incorporated herein by reference. The present invention replaces the combination reset mechanism of the '517 lock with one of two embodiments. The combination is reset by pushing an internal reset block inwardly. In the lock of the '517 patent, the reset block is pushed inwardly by pushing the locking head into the wire hole in the casing. A tapered surface on the locking head contacts an inclined surface of the reset block, pushing the reset block inwardly.

In one embodiment of the present invention, the '517 reset block is replaced by a reset block that has a reset button. The reset button extends from the reset block out of the casing. In order to reset the lock combination, the user presses and holds the reset button, sets the new combination, then releases the reset button.

The second embodiment also replaces the '517 block with a reset block that has a reset button. In addition, the second embodiment employs the locking head to hold the reset block in the reset position so that the user does not have to continually press the reset button during the reset procedure. The reset block has an arcuate cavity around the locking head. A flat shoulder on the lower portion of the locking head sits on a ledge on the surface of the cavity, preventing the locking head from being pushed into the wire hole. Pressing the reset button disengages the ledge from the locking head, allowing the user to push the locking head into the wire hole, which now holds the reset block in the reset position. After the new combination has been set, the user pulls the locking head from the wire hole, causing the reset block to return to its normal position, setting the new combination.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
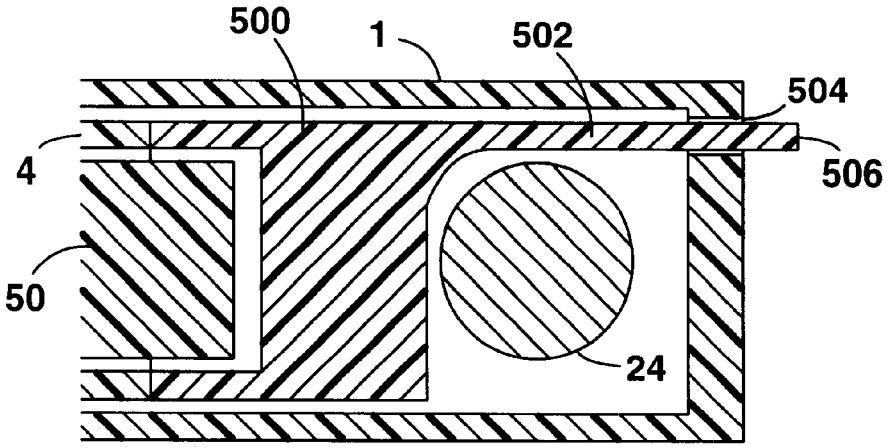
FIG. 1 is a top cross-sectional view detailing the first embodiment of the combination reset mechanism of the present invention.

As indicated above, the present invention is an improvement of an existing lock. The lock is described in detail in U.S. Pat. No. 4,896,517, incorporated herein by reference. This specification will first summarize the '517 patent and then describe in detail the improvement of the present invention.

Referring to the figures of the '517 patent, the lock of the '517 patent includes a casing 1, a wire means 2, a plurality of dials 3, a plurality of sleeves 4, a locking head latch 5, a resilient impinger 6, and a wire clutch means 7.

The casing 1 contains the internal components of the lock. The lower part of the casing 1 has space for the wire means 2. The wire means 2 includes a wire rope 21 wound on a spring-loaded reel 22. As the wire rope is pulled from the reel 22, the spring 23 is wound. When the wire rope 21 is released, the spring 23 unwinds, rotating the reel 22 to rewind the wire rope 21 back onto the reel 22. A locking head 24 is permanently attached to the outer end of the wire rope 21.

The wire clutch means 7 retains the wire rope 21 at the length pulled from the reel 22. A pushbutton 71 operates a pawl 73 that engages teeth 221 on the reel 22. It also operates a bifurcate portion 78 for straightening the wire rope 21 within the casing 1.

The upper part of the casing 1 has a vertical wire hole 12 from which the locking head 24 of the wire 21 is pulled, a vertical locking hole 13 into which the locking head 24 is inserted for locking, and a horizontal latch hole 14 in the side wall adjacent to the locking hole 13 for the latch pushbutton 51 that releases the locking head 24 from the locking hole 13. The spring-loaded impinger 6 sits in the lower end of locking hole 13. When the locking head 24 is pushed into the locking hole 13, it pushes against the impinger 6, compressing the impinger spring 62. When in this position, the impinger 6 prevents the clutch button 71 from operating. When the latch pushbutton 51 releases the locking head 24, the spring 62 causes the impinger 6 to push the locking head 24 from the locking hole 13.

Each combination dial 3 is an annular ring 31 with a plurality of grooves 321 formed in the bore. Each groove 321 is engageable with a tooth 41 formed on a surface of a sleeve 4. Each sleeve 4 includes a central hole 40 for slidably engaging a cylindrical rod 50 of the locking head latch 5 and a recess 42 in the central hole 40 engageable with a key 56 protruding from the cylindrical rod 50. The locking head latch 5 includes a latch pushbutton 51, a locking aperture 52 into which the locking head 24 is inserted, and a cylindrical rod 50 formed on a inner portion of the locking head latch 5 slidably engageable with a central hole 40 of the sleeve 4. The edge of the locking aperture 52 engages a neck portion 243 of the locking head 24 to secure the locking head 24 into the locking hole 13.

The combination dial grooves 321 are engaged with the sleeve teeth 41. When the combination dial 3 is rotated, the sleeve 4 also rotates. When the sleeves 4 are rotated so that the recesses 42 are all aligned with the cylindrical rod keys 56, the latch pushbutton 51 can be pushed inwardly, moving the edge of the locking aperture 52 from the locking head neck portion 243, releasing the locking head 24 from the locking aperture 52. A spring 55 biases the latch pushbutton 51 outwardly.

The present invention involves the combination reset mechanism of the lock. In the lock of the '517 patent, a sliding block 15 is movable inwardly when inward pressure is applied. When the sliding block 15 is so moved, it pushes the sleeves 4 inwardly until the sleeve teeth 41 disengage from the combination dial grooves 321, while straddling the locking latch cylindrical rod 50. Now the combination dials 3 can be rotated to a new combination. When the inward pressure is removed from the sliding block 15, the pushbutton bias spring 55 causes the sliding block 15 to move back to its normal position and also causes the sleeve teeth 41 to reengage with the combination dial grooves 321, setting the new combination.

In the lock of the '517 patent, inward pressure on the sliding block 15 is provided by the locking head 24. The locking head 24 includes a cylindrical portion 240 with a lower tapered surface 244 circumferentially formed on a lower portion of the cylindrical portion 240. The lower tapered surface 244 is tangentially engageable with an upper inclined surface 151 of the sliding block 15. When the locking head 24 is pushed into the wire hole 12, the locking head lower tapered surface 244 contacts the sliding block upper inclined surface 151, pushing the sliding block 15 inwardly. As indicated above, there is an inherent problem with this design. If the locking head 24 is accidentally pushed into the wire hole 12, the combination could be inadvertently changed.

Figure 2:
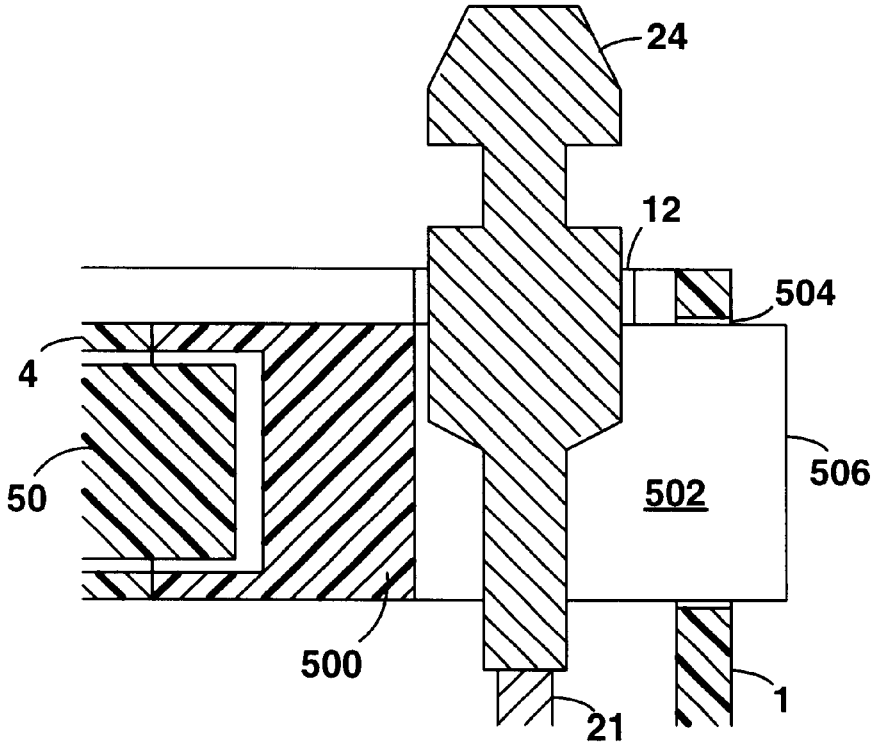
FIG. 2 is a front cross-sectional view detailing the combination reset mechanism of FIG. 1.

In one embodiment on the present invention, the reset mechanism of the '517 patent described above is replaced with the mechanism of FIGS. 1 and 2. In this mechanism, the locking head 24 is not used to reset the combination. The sliding block 15 of the '517 patent is replaced by a reset block 500. The reset block 500 has a leg 502 extending through a hole 504 in the side wall of the casing 1 adjacent to the wire hole 12 to a reset button 506 outside of the casing 1. Rather than pushing the locking head 24 into the wire hole 12 to reset the lock combination, the user pushes the reset button 506. This has the effect of pushing the sleeves 4 inwardly until the sleeve teeth 41 disengage from the combination dial grooves 321. As with the '571 patent, the combination dials 3 can be rotated to a new combination. When the user releases the reset button 506, inward pressure is removed from the reset block 500. The latch pushbutton bias spring 55 causes the reset block 500 to move back to its normal non-reset position and also causes the sleeve teeth 41 to reengage with the combination dial grooves 321, setting the new combination.

Figure 3:
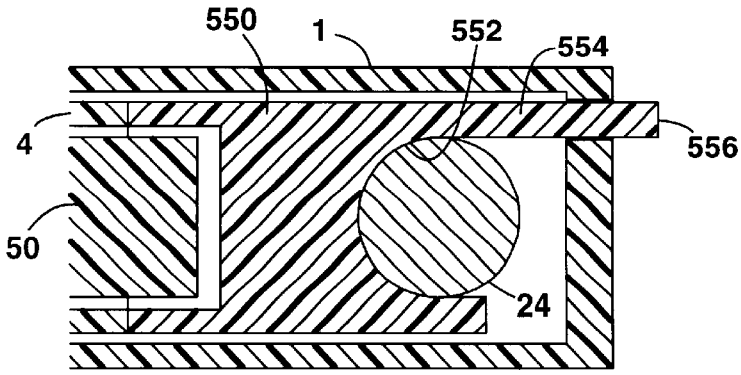
FIG. 3 is a top cross-sectional view detailing the second embodiment of the combination reset mechanism of the present invention in the normal position.
Figure 4:
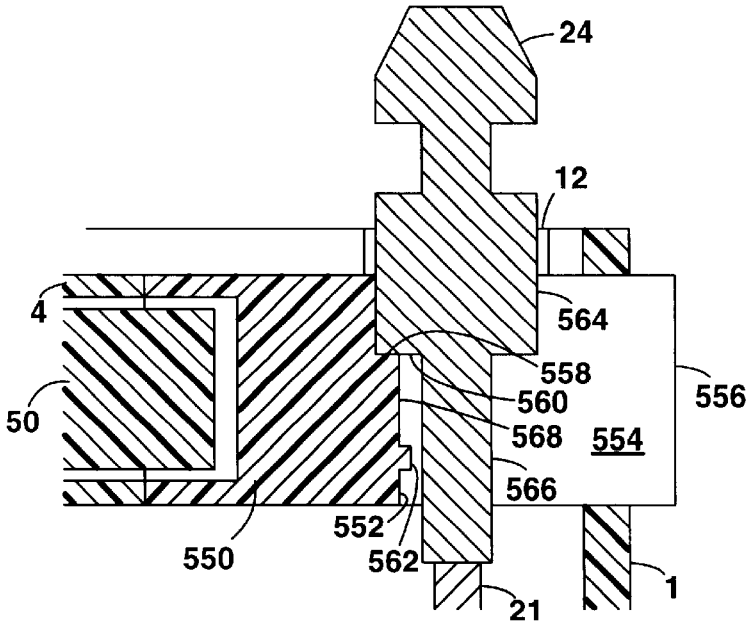
FIG. 4 is a front cross-sectional view detailing the combination reset mechanism of FIG. 3.
Figure 5:
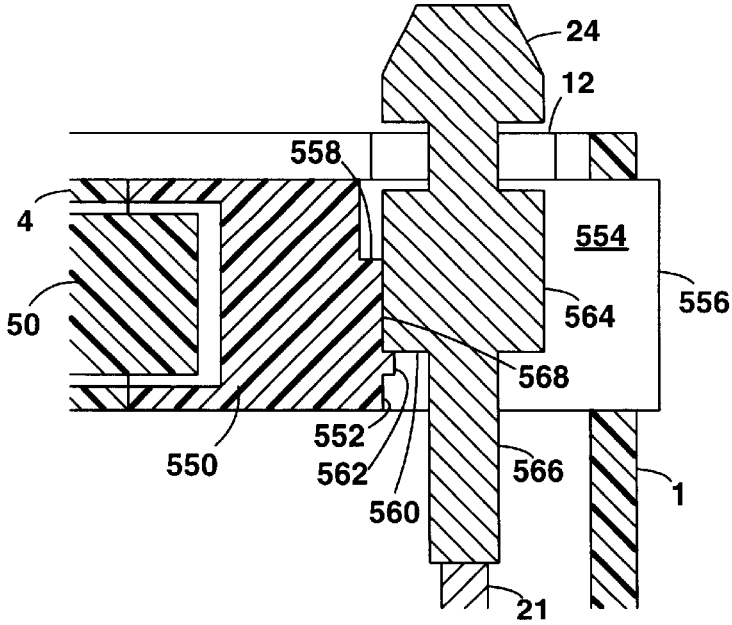
FIG. 5 is a front cross-sectional view detailing the combination reset mechanism of FIG. 3 in the reset position.

In the second embodiment of the present invention, the reset mechanism of the '517 patent is replaced with the mechanism of FIGS. 3–5. One characteristic of the first embodiment described above is that the user must maintain pressure on the reset button 506 during the reset procedure. The reset mechanism of this second embodiment removes that requirement by using the locking head 24 to hold the reset block 550 in the reset position while the user resets the combination.

The reset block 550 has an arcuate cavity 552. The reset button 556 is an extension of one of the legs 554 of the cavity 552. A portion of the inner surface of the cavity 552 is stepped to form a ledge 558. This embodiment also replaces the lower tapered surface 244 of the locking head 24 of the '517 patent with a flat shoulder 560 formed between the larger cylindrical portion 564 and the smaller cylindrical portion 566. When the reset block 550 is in its normal non-reset position and the locking head 24 is pushed into the wire hole 12, the locking head shoulder 560 contacts the ledge 558. This cooperation between the shoulder 560 and ledge 558 prevents the locking head 24 from being pushed any farther into the wire hole 12, as in FIG. 4. When the reset button 556 is pressed, the ledge 558 slides inwardly, removing the ledge 558 from the path of the locking head shoulder 560, and allowing the user to push the locking head 24 further into the wire hole 12 to a reset hold position, as in FIG. 5. If the reset button 556 is then released, the portion 568 of the arcuate cavity 552 below the ledge 558 contacts the larger cylindrical portion 564 of the locking head 24, thereby holding the reset block 550 in the reset position. Optionally, a protrusion 562 at the lower part of the arcuate cavity 552 cooperates with the locking head shoulder 560 to prevent the locking head 24 from being pushed into the wire hole 12 beyond the reset hold position. After the new combination has been set, the user pulls the locking head 24 from the wire hole 12. The pushbutton bias spring 55 pushes the reset block 550 back to its non-reset position, causing the sleeve teeth 41 to reengage with the combination dial grooves 321 and fixing the new combination.

Thus it has been shown and described a retractable wire lock with secure reset mechanism which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

We claim:

1. A wire lock comprising:

(a) a casing composed of two side walls having a left vertical locking hole and a right vertical wire hole formed in upper walls of said casing;

(b) a wire means including a wire rope normally resiliently wound on a reel pivotally secured in said casing;

(c) a locking head formed on an outermost end of said wire rope operatively inserted in said locking hole for locking said wire rope in said casing and retractably held in said wire hole when opening said wire lock;

(d) a plurality of dials respectively coupled with a plurality of sleeves rotatably mounted on a locking head latch formed in an upper portion of said casing, said latch having a latch pushbutton formed on an outer portion and protruding outwardly through a hole in a side wall of said casing adjacent to said locking hole, a cylindrical rod formed on an inner portion for rotatably securing said sleeves and dials thereon, and a locking extension formed in a central portion of said latch operatively engageable with said locking head for locking said wire lock; and (e) a reset block slidably mounted in said casing between said sleeves and said wire hole, said reset block having a recess for receiving said locking head latch cylindrical rod, said reset block having a reset pushbutton formed on an outer portion and protruding outwardly through a hole in a side wall of said casing adjacent to said wire hole, whereby upon an inward depression of said reset pushbutton, said reset block pushes toward said locking head latch to a reset position wherein said sleeves disengage from said dials for free rotation of said dials for resetting a new combination.

2. The wire lock of claim 1 wherein said locking head has a large cylindrical portion and a narrow cylindrical portion with a flat shoulder therebetween, said reset block includes an arcuate cavity mating with said locking head large cylindrical portion, said arcuate cavity being formed with a ledge, whereby, when said reset block is in a non-reset position, said shoulder and said ledge cooperate to prevent said locking head from being pushed into said wire hole, and when said reset block is in said reset position, said locking head is able to be pushed into said wire hole to a reset hold position that holds said reset block in said reset position.

3. The wire lock of claim 2 wherein said arcuate cavity includes a protrusion below said ledge, whereby said shoulder and said protrusion cooperate to prevent said locking head from pushing into said wire hole beyond said reset hold position when said reset block is in said reset position.

4. The wire lock of claim 1 wherein said wire lock includes a resilient impinger generally formed as a vertical rod resiliently protruding upwardly to operatively urge said locking head upwardly outwardly beyond said casing when opening said wire lock.

5. The wire lock of claim 1 wherein said wire lock includes a wire clutch means controlling a rewinding of said wire rope on said reel of said wire means or a releasing of said wire rope unwound from said reel.

6. A wire lock comprising:

(a) a casing composed of two side walls having a left vertical locking hole and a right vertical wire hole formed in upper walls of said casing;

(b) a wire means including a wire rope normally resiliently wound on a reel pivotally secured in said casing;

(c) a locking head formed on an outermost end of said wire rope operatively inserted in said locking hole for locking said wire rope in said casing and retractably held in said wire hole when opening said wire lock;

(d) a plurality of dials respectively coupled with a plurality of sleeves rotatably mounted on a locking head latch formed in an upper portion of said casing, said latch having a latch pushbutton formed on an outer portion and protruding outwardly through a hole in a side wall of said casing adjacent to said locking hole, a cylindrical rod formed on an inner portion for rotatably securing said sleeves and dials thereon, and a locking extension formed in a central portion of said latch operatively engageable with said locking head for locking said wire lock;

(e) a reset block slidably mounted in said casing between said sleeves and said wire hole, said reset block having a recess for receiving said locking head latch cylindrical rod, said reset block having a reset pushbutton formed on an outer portion and protruding outwardly through a hole in a side wall of said casing adjacent to said wire hole, whereby upon an inward depression of said reset pushbutton, said reset block pushes toward said locking head latch to a reset position wherein said sleeves disengage from said dials for free rotation of said dials for resetting a new combination;

(f) a resilient impinger generally formed as a vertical rod resiliently protruding upwardly to operatively urge said locking head upwardly outwardly beyond said casing when opening said wire lock; and (g) a wire clutch means controlling a rewinding of said wire rope on said reel of said wire means or a releasing of said wire rope unwound from said reel.

7. The wire lock of claim 6 wherein said locking head has a large cylindrical portion and a narrow cylindrical portion with a flat shoulder therebetween, said reset block includes an arcuate cavity mating with said locking head large cylindrical portion, said arcuate cavity being formed with a ledge, whereby, when said reset block is in a non-reset position, said shoulder and said ledge cooperate to prevent said locking head from being pushed into said wire hole, and when said reset block is in said reset position, said locking head is able to be pushed into said wire hole to a reset hold position that holds said reset block in said reset position.

8. The wire lock of claim 7 wherein said arcuate cavity includes a protrusion below said ledge, whereby said shoulder and said protrusion cooperate to prevent said locking head from pushing into said wire hole beyond said reset hold position when said reset block is in said reset position.

* * * * *